US009994937B1

(12) United States Patent
Wedding et al.

(10) Patent No.: US 9,994,937 B1
(45) Date of Patent: Jun. 12, 2018

(54) MO-SI-B MANUFACTURE

(71) Applicants: Carol Ann Wedding, Toledo, OH (US); Joe K. Cochran, Marietta, GA (US); Oliver M. Strbik, III, Holland, OH (US); Peter E. Marshall, Perrysburg, OH (US)

(72) Inventors: Carol Ann Wedding, Toledo, OH (US); Joe K. Cochran, Marietta, GA (US); Oliver M. Strbik, III, Holland, OH (US); Peter E. Marshall, Perrysburg, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 405 days.

(21) Appl. No.: 14/717,603

(22) Filed: May 20, 2015

Related U.S. Application Data

(60) Provisional application No. 62/000,739, filed on May 20, 2014.

(51) Int. Cl.

| | |
|---|---|
| ***B22F 3/12*** | (2006.01) |
| ***C22C 32/00*** | (2006.01) |
| ***B22F 9/02*** | (2006.01) |
| ***B22F 9/04*** | (2006.01) |
| ***C22C 1/05*** | (2006.01) |

(52) U.S. Cl.
CPC ..... *C22C 32/0073* (2013.01); *B22F 3/12* (2013.01); *B22F 9/026* (2013.01); *B22F 9/04* (2013.01); *C22C 1/05* (2013.01); *B22F 2009/043* (2013.01)

(58) Field of Classification Search
None
See application file for complete search history.

(56) References Cited

U.S. PATENT DOCUMENTS

| | | | | |
|---|---|---|---|---|
| 5,595,616 | A | 1/1997 | Perepezko | |
| 5,693,156 | A | 12/1997 | Berczik | |
| 6,652,674 | B1 | 11/2003 | Woodward et al. | |
| 7,005,191 | B2 | 2/2006 | Perepezko | |
| 7,560,138 | B2 | 7/2009 | Perepezko et al. | |
| 7,560,198 | B2 | 7/2009 | Perepezko et al. | |
| 2006/0169369 | A1 | 8/2006 | Jehanno | |
| 2009/0011266 | A1 | 1/2009 | Cochran et al. | |
| 2010/0154590 | A1* | 6/2010 | Myers | B22F 1/0096 75/255 |

* cited by examiner

*Primary Examiner* — Jessee R Roe
*Assistant Examiner* — Ngoclan T Mai
(74) *Attorney, Agent, or Firm* — Donald K. Wedding

(57) ABSTRACT

A method for controlling the formation of molybdenum solid solution in Mo—Si—B composites which comprises processing at 1400° C. or less to minimize, if not prevent, the silicon from going into solid solution in the molybdenum.

18 Claims, 2 Drawing Sheets

MO-SI-B MANUFACTURE

RELATED APPLICATION

This application claims benefit under 35 U.S.C. 119(e) from provisional U.S Patent Application Ser. No. 60/000,739 filed May 20, 2014.

BACKGROUND OF INVENTION

Molybdenum-Silicon-Boron (Mo—Si—B) is known in the prior art. It is being investigated for use in high temperature applications such as aircraft engines. When mixed in the proper ratios and heated to high temperatures these elements of molybdenum, silicon, and boron form three phases. $Mo_3Si$ and $Mo_5SiB_2$ (referred to by those of skill in the metallurgical and ceramic arts as A15 and T2 respectively) are the hard phases interspersed in an essentially molybdenum phase. Because of the solubility of silicon in molybdenum at high temperatures, the molybdenum phase is actually a solid solution between the molybdenum and silicon, referred to as molybdenum solid solution or $Mo_{ss}$.

Mo—Si—B is useful in high temperature applications, including high temperature oxygen rich applications. When Mo—Si—B compositions are subjected to heat in air or substantially oxygen atmosphere, the T2 and A15 form a protective borosilicate glass on the exterior of the material. This glassy layer protects the $Mo_{ss}$ from oxidizing and volatilizing in air. However Mo—Si—B has limited application because the $Mo_{ss}$ phase is brittle at temperatures below 1000° C. To be useful for many applications the material must be ductile at room temperature. By reducing the amount of silicon present in the $Mo_{ss}$ the ductile to brittle transition temperature may be reduced, thus allowing the material to be ductile at lower temperatures, including room temperature.

Typically silicon and molybdenum form a solid solution during processing at high temperature. This begins to occur at temperatures above about 1300° C. As temperature increases above 1300° C., the amount of silicon in the solid solution increases. Typical melt processes require temperatures in excess of 1600° C. This introduces several atomic percent of silicon into the $Mo_{ss}$ which results in a high ductile to brittle transition temperature (1000° C.-1100° C. as described above). Disclosed in this patent is a low temperature process which substantially reduces the amount of silicon in the $Mo_{ss}$ phase, thus allowing for low temperature ductility.

MO—SI—B ALLOY PRIOR ART

Mo—Si—B alloys have been disclosed in the prior art. A 1600° C. isothermal section of a Mo—Si—B ternary phase diagram 201 is shown in FIG. 2. The desired properties of high temperature applications such as turbine blades may be found in Mo—Si—B compositions in the molybdenum rich corner 202 of the phase diagram 201. This region includes the three phases of matter: $Mo_{ss}$ and two intermetallic phases A15 and T2. These three phases have melting points above 2000° C. and the phase field is stable down to room temperature, making these alloys excellent candidates for high temperature structural use.

PRIOR ART MO—SI—B COMPOSITIONS

A variety of Mo—Si—B compositions have been disclosed in the prior art.

U.S. Pat. No. 5,693,156 (Berczik) describes a molybdenum alloys defined by the compositional points of the phase diagram for a ternary system: metal-1.0% Si-0.5% B, metal-1.0% Si-4.0% B, metal-4.5% Si-0.5% B, and metal-4.5% Si-4.0% B; wherein percentages are weight percent and wherein said metal consists essentially of molybdenum as the major component.

U.S. Pat. No. 6,652,674 (Woodard et al.) describes addition of minor components to Mo—Si—B alloys such as Fe, Ni, Co and Cu to improve oxidation resistance.

U.S. Pat. No. 7,005,191 (Perepezko et al.) discloses multiphase intermetallic materials composed of molybdenum silicides including a multiphase, multilayered oxidation resistant structure comprising: Mo—Si—B alloy substrate with a multiphase protective coating.

U.S. Patent Application Publication Ser. No. 2006/0169369 (Jehanno) describes an Oxide Dispersion Strengthened (ODS) Mo—Si—B alloy, comprising: intermetallic phases molybdenum silicide and molybdenum boron silicide, and an optional component of molybdenum boride, with a total content of intermetallic phase constituents amounting to 25% to 90% by volume and a proportion of further microstructural constituents amounting to less than 5% by volume; an amount of 0.1%-5% by volume of one or more oxides or mixed oxides with a vapor pressure at 1500° C. of less than 5×10-2 bar; and a remainder of molybdenum or molybdenum solid solution. Oxides can be added to the Mo—Si—B alloy to increase the strength, and to improve the ductility properties. Preferred oxides include: $Y_2O_3$, $ZrO_2$, $HfO_2$, $TiO_2$, $Al_2O_3$, CaO, MgO and SrO.

MO-SI-B FABRICATION METHOD

A variety of methods for producing Mo—Si—B alloys have emerged. With the exception of methods disclosed in U.S. Patent Application Publication No. 2009/0011266 (Cochran et al.), much of the research has focused on melt-based processing or consolidation of pre-alloyed powders formed by inert gas atomization. Molybdenum has the highest melting point of the three phases in the alloy, so these methods necessarily result in molybdenum solid solution. The resulting microstructures produced by these methods are coarse grained with isolated molybdenum regions.

U.S. Pat. No. 5,595,616 (Berczik) describes a process for fabricating Mo—Si—B alloys in which elemental molybdenum, silicon and boron, in defined proportions are combined in a melt. Alloy from the melt is rapidly solidified into a fine powder using an atomization device. The powder is extruded at 1500° C. The extruded powder is swaged at 1370° C. with all heat treatments done in an inert atmosphere, in vacuo, or in hydrogen.

U.S. Pat. No. 7,560,138 (Perepezko et al.) describes a method for producing an oxidation resistant multi-layered structure, by exposing an Mo—Si—B alloy substrate or a substrate having an Mo—Si—B alloy surface character to a vapor comprising silicon and annealing the substrate to form a layer of $MoSi_2$ on the substrate; and annealing the $MoSi_2$ layer to produce an outer borosilicate layer, an intermediate layer comprising molybdenum disilicides, molybdenum silicides, or combinations thereof, and an inner borosilicide layer, wherein the inner borosilicide layer is integrated with the substrate.

U.S. Patent Application Publication No. 2006/0169369 (Jehanno) describes an Oxide Dispersion Strengthened Mo—Si—B fabricated by mechanical alloying and compacted at temperatures in the range from 1300° C.-1500° C.

U.S. Patent Application Publication No. 2009/0011266 (Cochran et al.) describes a method of making a molybdenum, molybdenum silicide and molybdenum silicon boride composite material, in which a boron nitride powder, a silicon nitride powder and a molybdenum powder are mixed to form a composite precursor. The composite precursor is sintered in an atmosphere consisting essentially of hydrogen and an inert gas to form a sintered material. The sintered material is hot isostatic pressed to form the composite material into a final shape.

DETAILED DESCRIPTION OF THE DRAWINGS

Figure 1:
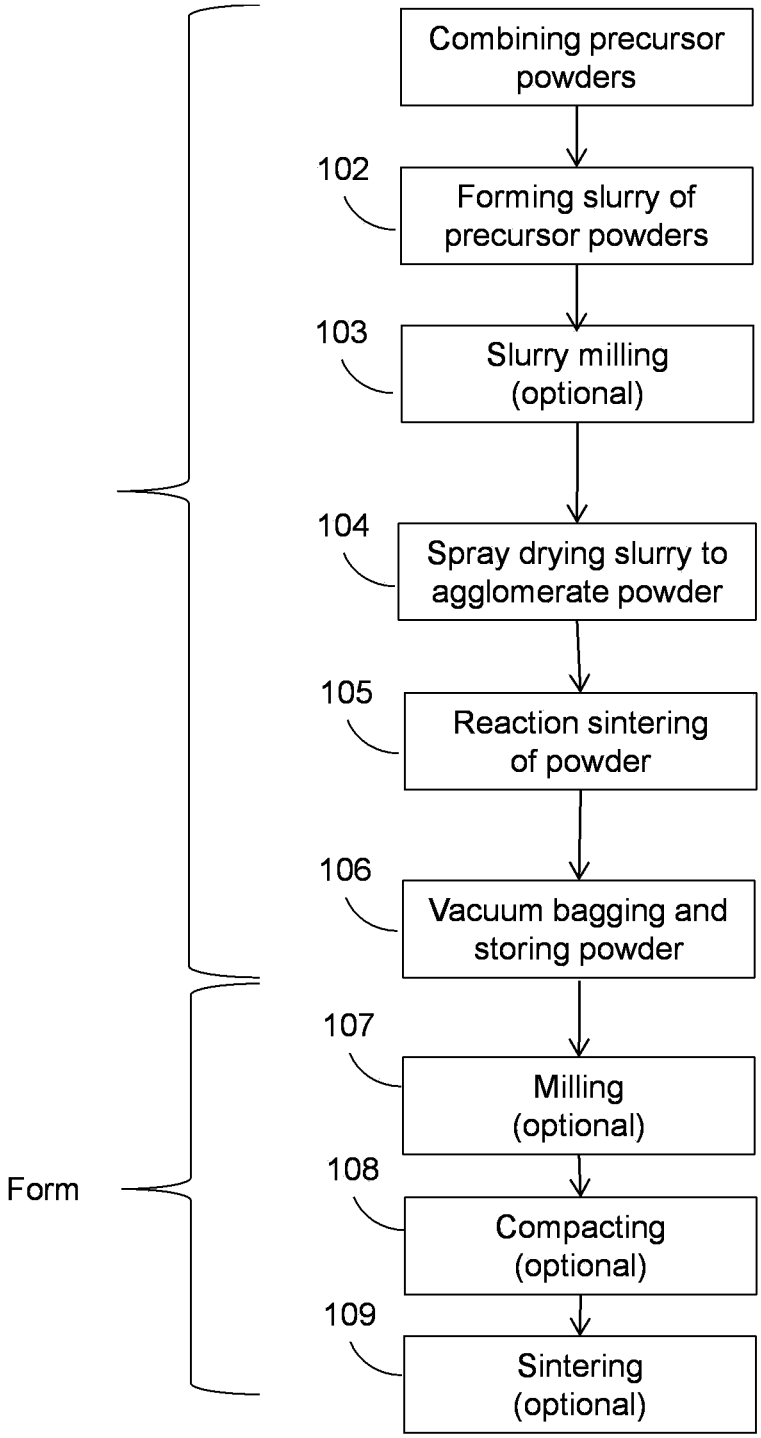
FIG. 1 is a block diagram illustrating the fabrication steps for producing a high density part or article of manufacture.
Figure 2:
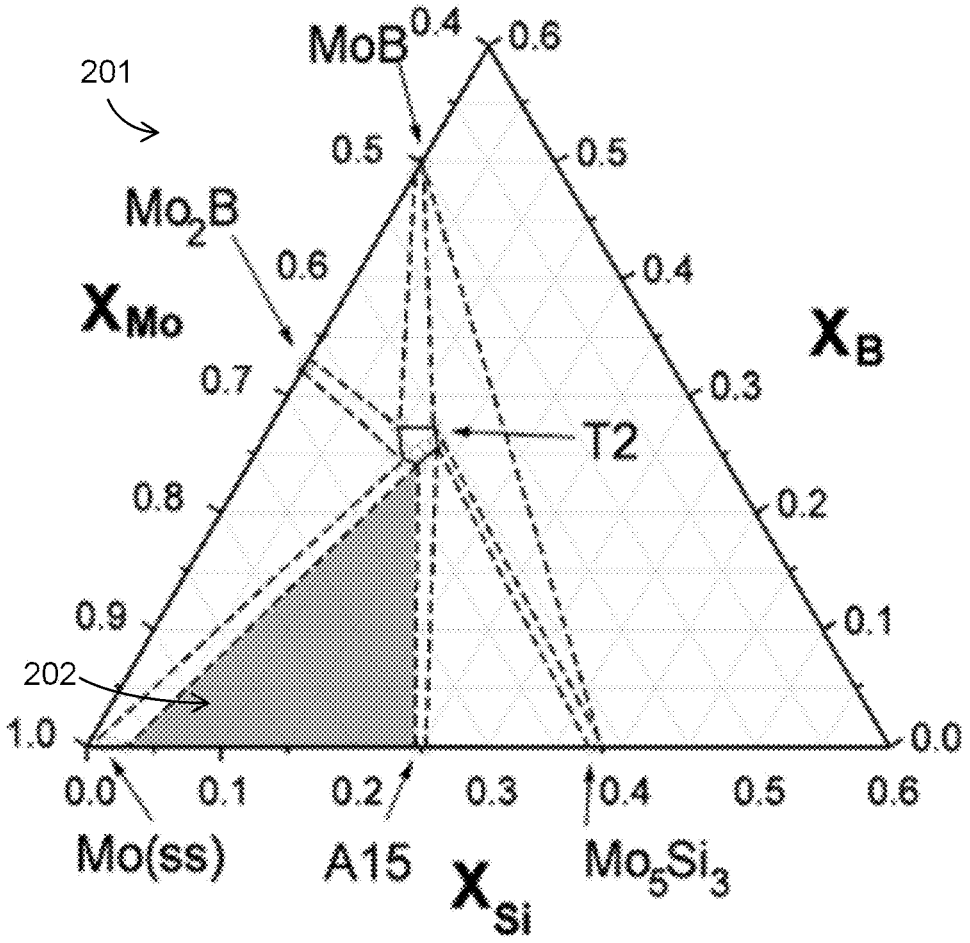
FIG. 2 is a portion of a ternary phase diagram for molybdenum, boron, and silicon at 1600° C.

FIG. 1 shows the method steps 101, 102, 103, 104, 105, 106, 107, 108 and 109 for producing Mo—Si—B with reduced silicon content in the $Mo_{ss}$ phase. It consists of the steps of forming Mo—Si—B powder. Optionally the powder may be compacted and sintered to from a part or slug Step 101 comprises combining precursor powders which when heated will react to form Mo-Si-B. These submicron powders include at least boron nitride (BN), silicon nitride ($Si_3N_4$) and molybdenum. These powders are added in such a ratio as to form beneficial amounts of T2 and A15 in a continuous matrix of molybdenum. T2 and A15 are formed in the presence of heat via the following reactions.

$$5Mo + \frac{1}{3}Si_3N_4 + 2BN \rightarrow Mo_5SiB_2 + \frac{5}{3}N_2 \quad \text{T2}$$

$$3Mo + \frac{1}{3}Si_3N_4 \rightarrow Mo_3Si + \frac{2}{3}N_2 \quad \text{A15}$$

Other additives may be included in this step. Additives known in the prior art may be included to (1) promote wetting of the borosilicate layer once it has formed, (2) raise the melting point of the borosilicate, (3) form a more refractory oxide layer below the initial borosilicate layer further impeding oxygen transport to the molybdenum matrix (4) strengthen the composite.

Step 102 comprises forming a slurry. The precursor powders of Step 101 are dispersed or dissolved in a liquid (such as acetone, or other organic liquid) to form a suspension. An organic dispersant and binder, such as a methyl methacrylate copolymer, can be added to the suspension. A lubricant, such as stearic acid, can also be added to the suspension.

Step 103 comprises optionally milling the suspension to break up agglomerates of the boron nitride powder, the silicon nitride powder and the molybdenum powder.

Step 104 comprises spray drying the slurry to form a homogenous powder mixture.

Step 105 comprises reaction sintering the homogenous powder in a reducing atmosphere including but not limited to hydrogen at a temperature at least below 1400° C. more preferably below 1350° C. and even more preferably below 1300° C. The resulting powder consists essentially of phases: T2, A15 and only trace amounts of silicon in the $Mo_{ss}$. When fired at 1400° C. there is 2% or less atoms of silicon in the $Mo_{ss}$ phase. When fired at 1300° C. there is about 1.2% or less atoms of silicon in the $Mo_{ss}$ phase.

Step 106 comprises storing the material in oxygen free atmosphere. At this stage, care should be taken to limit the exposure of this material to air. The high surface area of the powder is susceptible to oxidation. Viable storage methods include but are not limited to vacuum bagging.

Step 107 comprises milling the powder to break up large agglomerates formed as a result of sintered necks at particle-particle contact points Optionally, a part or slug may be formed from the powder using standard powder processing methods. These include but are not limited to Step 108 and Step 109.

Step 108 comprises compacting the powder. This may be done in an inert atmosphere. Potential compacting methods include cold isostatic pressing at above 10,000 psi and temperatures below 200° C. Vibratory methods may also be used to compact the powder into a mold or form.

Step 109 comprises sintering the powder in an inert or reducing environment at a temperature below 1400° C. more preferably below 1350° C. and even more preferably below 1300° C. To achieve a dense part, it is desirable to sinter under pressure of 10,000 psi or greater with a more preferable pressure of 50,000 psi. The resulting sintered part is at least 98% of the 100% theoretical density and has substantially reduced silicon in the $Mo_{ss}$ phase. When fired at 1400° C. there is 2% or less atoms of silicon in the $Mo_{ss}$ phase. When fired at 1300° C. there is about 1.2% or less atoms of silicon in the $Mo_{ss}$ phase.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. The process of forming a molybdenum silicon boron composite which includes the steps of:

combining precursor powders and heating to form Mo—Si—B;

forming a slurry of precursor powders and liquid;

spray drying the slurry to form a homogenous powder mixture;

sintering the homogenous powder in a reducing atmosphere;

compacting the powder; and sintering the compacted powder.

2. The process of claim 1 in which the precursor powders include molybdenum, silicon nitride, and boron nitride.

3. The process of claim 1 in which the slurry is ball milled prior to spraying.

4. The process of claim 1 in which spray drying parameters of drying temperature and slurry feed rate are controlled to achieve a powder particle size below 100 microns.

5. The process of claim 4 in which the spray drying parameters of drying temperature and feed rate are controlled to achieve a powder particle size between 10 to 60 microns.

6. The process of claim 1 in which teh sintering of the homogeneous powder is at a temperature below 1400° C.

7. The process of claim 1 in which the sintering of the homogeneous powder is at a temperature below 1350° C.

8. The process of claim 1 in which the sintering of the homogeneous powder is at a temperature below 1300° C.

9. The process of claim 1 in which the reducing atmosphere is hydrogen.

10. The process of claim 1 in which the reducing atmosphere is carbon monoxide.

11. The process of claim 1 in which the sintened compacted powder is stored under vacuum.

12. The process of claim 1 in which the powder is milled prior to compacting.

13. The process of claim 1 in which the compacting and sintering are conducted in a reduced oxygen atmosphere.

14. The process of claim 1 in which the compacting is achieved through cold isostatic pressing at a pressure above 10,000 psi.

15. The process of claim 1 in which the sintering of the compacted powder is conducted at a temperature below 1400° C.

16. The process of claim 1 in which the sintering of the compacted powder is conducted at a temperature below 1300° C.

17. The process of claim 1 in which the sintering of the compacted powder is conducted under a pressure greater than 10,000 psi.

18. The process of claim 1 in which the sintering of the compacted powder is conducted under a pressure greater than 50,000 psi.

* * * * *